US010914299B2

(12) United States Patent
Hannemann et al.

(10) Patent No.: US 10,914,299 B2
(45) Date of Patent: Feb. 9, 2021

(54) DIAPHRAGM PUMP COMPRISING DUST SUCTION FROM BELOW

(71) Applicant: Dipl. Ing. Ernst Schmitz GmbH & Co. KG Maschinen und Apparatebau, Toenisvorst (DE)

(72) Inventors: Frank Hannemann, Röttenbach (DE); Thomas Metz, Nuremberg (DE); Sebastian Rahm, Dresden (DE)

(73) Assignee: Dipl. Ing. Ernst Schmitz GmbH & Co. KG Maschinen und Apparatebau, Toenisvorst (DE)

( * ) Notice: Subject to any disclaimer, the term of this patent is extended or adjusted under 35 U.S.C. 154(b) by 117 days.

(21) Appl. No.: 16/072,531

(22) PCT Filed: Dec. 20, 2016

(86) PCT No.: PCT/EP2016/081838
§ 371 (c)(1),
(2) Date: Jul. 25, 2018

(87) PCT Pub. No.: WO2017/129327
PCT Pub. Date: Aug. 3, 2017

(65) Prior Publication Data

US 2019/0063419 A1 Feb. 28, 2019

(30) Foreign Application Priority Data

Jan. 27, 2016 (DE) ..... 10 2016 201 182

(51) Int. Cl.
*F04B 43/067* (2006.01)
*F04B 15/02* (2006.01)
(Continued)

(52) U.S. Cl.
CPC ..... *F04B 43/067* (2013.01); *F04B 15/02* (2013.01); *F04B 43/02* (2013.01); *F04B 43/06* (2013.01); *F04B 45/04* (2013.01)

(58) Field of Classification Search
CPC ..... F04B 43/067; F04B 15/02; F04B 43/02; F04B 43/06; F04B 45/04
(Continued)

(56) References Cited

U.S. PATENT DOCUMENTS 3,138,856 A 6/1964 Kuchek
4,180,353 A 12/1979 Geidies
(Continued)

FOREIGN PATENT DOCUMENTS

CH 466 134 A 11/1968
DE 427455 C 4/1926
(Continued)

OTHER PUBLICATIONS

International Search Report dated May 2, 2017, for PCT/EP2016/081838.
(Continued)

*Primary Examiner* — Connor J Tremarche
(74) *Attorney, Agent, or Firm* — Collard & Roe, P.C.

(57) ABSTRACT

A diaphragm pump for pneumatic high-pressure delivery of 1 to 10 MPa of fluidised dusts, in which filling occurs from below via pneumatic suction by hydraulic reciprocating movement of the diaphragm and also by applying a negative pressure. The dust is held in a loosened fluidised state over the entire pump operation, wherein the high-pressure gas requirement is low. A drive of the diaphragm pump by a hydraulic pressure intensifier and multiple diaphragm pumps are operated in a phase-displaced manner with respect to each other. A dust delivery system which uses the diaphragm pump is operated with a low drive power.

13 Claims, 3 Drawing Sheets

(51) Int. Cl.
*F04B 45/04* (2006.01)
*F04B 43/02* (2006.01)
*F04B 43/06* (2006.01)

(58) Field of Classification Search
USPC ..... 417/395
See application file for complete search history.

(56) References Cited

U.S. PATENT DOCUMENTS

| | | | | |
|---|---|---|---|---|
| 4,521,165 | A * | 6/1985 | Handleman | B65G 53/08 406/50 |
| 4,695,214 | A * | 9/1987 | Scinta | B01J 3/02 414/217 |
| 4,818,191 | A | 4/1989 | Schlake | |
| 5,564,911 | A * | 10/1996 | Santa | F04B 43/0054 251/297 |
| 5,758,563 | A * | 6/1998 | Robinson | F01L 31/02 417/393 |
| 5,980,963 | A * | 11/1999 | Bazan | A23B 4/26 417/413.1 |
| 6,447,216 | B1 | 9/2002 | Higuchi et al. | |
| 6,464,474 | B2 | 10/2002 | Schluecker | |
| 6,796,215 | B1 | 9/2004 | Hauser et al. | |
| 7,607,398 | B2 | 10/2009 | Tietze et al. | |
| 8,851,406 | B2 | 10/2014 | Sonwane et al. | |
| 9,138,672 | B2 | 9/2015 | Ehrich et al. | |
| 9,347,444 | B2 | 5/2016 | Nettesheim et al. | |
| 2007/0065308 | A1 | 3/2007 | Yamamoto et al. | |
| 2007/0074643 | A1 | 4/2007 | Tietze et al. | |
| 2010/0021247 | A1 | 1/2010 | Aldred et al. | |
| 2011/0100274 | A1* | 5/2011 | Kuske | B01J 8/0015 110/347 |
| 2011/0155662 | A1 | 6/2011 | Liu et al. | |
| 2012/0122042 | A1 | 5/2012 | Brueggemann | |
| 2013/0287615 | A1* | 10/2013 | Fong | F04B 1/02 417/523 |
| 2014/0037466 | A1* | 2/2014 | Nettesheim | F04B 43/0081 417/53 |
| 2014/0112802 | A1* | 4/2014 | Hannemann | F04B 15/023 417/53 |

FOREIGN PATENT DOCUMENTS

| | | | |
|---|---|---|---|
| DE | 449676 | C | 9/1927 |
| DE | 485635 | C | 11/1929 |
| DE | 551066 | C | 5/1932 |
| DE | 568999 | C | 1/1933 |
| DE | 596565 | C | 5/1934 |
| DE | 615779 | C | 7/1935 |
| DE | 650988 | C | 10/1937 |
| DE | 656009 | C | 1/1938 |
| DE | 1008201 | B | 5/1957 |
| DE | 1175653 | B | 8/1964 |
| DE | 81606 | A1 | 4/1971 |
| DE | 2722931 | A1 | 11/1978 |
| DE | 147188 | A3 | 3/1981 |
| DE | 3035745 | A1 | 5/1982 |
| DE | 3909800 | A1 | 9/1990 |
| DE | 102005047583 | B4 | 4/2009 |
| DE | 102008007033 | A1 | 8/2009 |
| DE | 102008009679 | A1 | 8/2009 |
| DE | 102008049542 | A1 | 4/2010 |
| DE | 102008052673 | A1 | 4/2010 |
| DE | 102009016191 | A1 | 10/2010 |
| DE | 102008049542 | B4 | 12/2011 |
| DE | 102011007066 | A1 | 10/2012 |
| DE | 102011052432 | A1 | 10/2012 |
| DE | 102009016191 | B4 | 4/2013 |
| DE | 10 2012 216 084 | A1 | 3/2014 |
| DE | 202007019632 | U1 | 1/2015 |
| DE | 10 2014 212 919 | A1 | 1/2016 |
| DE | 10 2016 201 182 | A1 | 7/2017 |
| EP | 0 732 501 | A1 | 9/1996 |
| EP | 1 134 414 | A2 | 9/2001 |
| GB | 2004993 | A | 4/1979 |
| WO | 92/19866 | A1 | 11/1992 |
| WO | 01/14744 | A1 | 3/2001 |
| WO | 2009095290 | A2 | 8/2009 |
| WO | 2010037601 | A1 | 4/2010 |
| WO | 2009095290 | A3 | 3/2011 |

OTHER PUBLICATIONS

International Search Report of PCT/EP2017/071089, dated Nov. 17, 2017.

International Search Report of PCT/EP2017/071073, dated Dec. 6, 2017.

International Search Report of PCT/EP2017/071066, dated Dec. 5, 2017.

Industriepumpen + Kompressoren, "Prozesspumpen mit zustandsüberwachter redundanter Schlauchmembran-Einspannung" (with English translation of title page and Abstract of article) Industry pumps + Compressors: Magazine for the praxis of pump and compressor technique, "Process pumps with condition-watched redundant hose membrane gripping," by Heinz M. Naegel, 16 year, brochure 3, 2010, pp. 120-123.

* cited by examiner

DIAPHRAGM PUMP COMPRISING DUST SUCTION FROM BELOW

CROSS REFERENCE TO RELATED APPLICATIONS

This application is the US National Stage of International Application No. PCT/EP2016/081838 filed Dec. 20, 2016, and claims the benefit thereof. The International Application claims the benefit of German Application No. DE 102016201182.0 filed Jan. 27, 2016. All of the applications are incorporated by reference herein in their entirety.

FIELD OF INVENTION

The invention relates to a diaphragm pump for the pneumatic high-pressure delivery of 1 to 10 MPa fluidized dusts, and to a method for operating a diaphragm pump of said type.

BACKGROUND OF INVENTION

For low-pressure applications in the range of approximately 0.1 to 0.2 bar pressure elevation, use is made in practice of delivery screws with slight bulk material compression and subsequent gas injection for pneumatic bulk material delivery, see DD000000081606A1, DE000003035745A1, DE000000656009A, DE000000650988A, DE000000615779A, DE000000596565A, DE000000568999A, DE000000551066A, DE000000485635A, DE000000449676A, DE000000427455A. For somewhat higher pressures up to approximately 0.3 MPa, use is instead made of screw cellular wheels, see DE102009016191B4, DE102009016191A1. If multiple dust pumps are connected in series, it is possible to achieve correspondingly higher pressures, which is however associated with very high outlay in terms of apparatus for high-pressure applications, see DE102008049542B4, DE102008049542A1, DE102008007033A1, WO002010037601A1, WO002009095290A3, WO002009095290A2. In addition to this functional principle of the screw conveyors and cellular wheels, use is also made of dust pumps based on the principle of compressed-air diaphragm pumps, wherein, in this case, too, only low pressures are possible, DE 3909800 A1.

Whereas dust pumps are industrially used for low pressures, nowadays only lock processes have become industrially established for high-pressure processes in the range from 1 to 10 MPa, see DE102005047583B4, DD147188A3, DE102008052673A1. To reduce the investment and operating costs of such lock systems, dust pumps for high-pressure applications are also being developed, wherein the following methods are known:

For high-pressure applications in the range from 1 to 10 MPa, dust pumps based on the principle of the extrusion press are known. Here, the bulk material is mechanically compacted, as in an extrusion press, in a tapering channel to form a briquette, and thus a high pressure barrier composed of channel and briquette is formed, which is necessary for the sealing between high-pressure part and low-pressure part, see US000008851406B2, US020100021247A1. A disadvantage here is the high level of wear owing to the high acting friction forces, and the problem that the mechanical bulk material characteristics are significantly changed by this process, because, downstream of the pump, the bulk material is present in the form of briquette-like bulk material agglomerations. In particular for consumers such as dust combustion or dust gasification systems, renewed grinding under pressure is then necessary, which constitutes a hitherto unresolved problem.

Aside from the principle of the extrusion press, the piston pump principle is also known for high-pressure applications. Embodiments known in this regard are described in DE000001008201A, DE000001175653A, DE000002722931A1, DE102008009679A1. A major disadvantage here is the high, hitherto unresolved, level of wear to the dry-running piston rings. This problem can be solved through the use of diaphragms as presented in DE102011007066A1.

Here, however, owing to the gravity-driven filling process—as is also the case in all other known dust pumps and lock systems—relatively large cross sections and dimensions are necessary.

SUMMARY OF INVENTION

The invention is based on the problem of specifying a pump head for the pneumatic high-pressure delivery of fluidized bulk material, and a method for operating the pump head, in the case of which the bulk material is kept in a loosened, fluidized state throughout the entire pumping process.

The problem is solved by means of a diaphragm pump for the pneumatic high-pressure delivery of fluidized dusts, and by means of a method for the operation of a diaphragm pump of said type.

In the case of the dust pump according to the invention, the filling is performed by pneumatic induction, wherein the bulk material is kept in a loosened, flowable state throughout the entire pumping process, and instances of dust compaction are avoided in targeted fashion. Here, a highly compact and thus economical design is realized.

The pneumatic induction has numerous crucial advantages in relation to known dust pump systems: the cross section of the suction line 17 and thus the size of the inlet valve 8 and of the port on the pump head are much smaller in relation to a case of gravity-driven filling, whereby the pump head can be designed to be correspondingly smaller. Furthermore, the filling of the dust chamber can take place from below. This has the advantage that the construction of the pump head in the region of the diaphragm and in the hydraulic region is simplified, because there is no need for a dust leadthrough from above, which would otherwise be the case with gravity-driven filling. It is furthermore possible for the dust pump to be positioned adjacent to rather than below the hopper 11, which in turn saves structural height and increases the economy of such installations. Finally, by means of this arrangement, it is possible to realize a very large loosening surface 4 in terms of construction, which is necessary for the avoidance of instances of dust compaction and for short cycle times.

The pressure intensifier illustrated in FIG. 3, and thus also the separation of the hydraulic system into primary hydraulics 15—between pressure intensifier and hydraulic assembly—and secondary hydraulics 16—between diaphragm 3 and pressure intensifier 13—offer the following advantages: the pressure of the hydraulic assembly can be selected independently of the process pressure, whereby inexpensive standard hydraulic assemblies can be used instead of custom-made designs. Since, in general, the pressure of the hydraulic assembly (20-30 MPa) is significantly higher than the required process pressure in the dust system (1-10 MPa), the volume flows in the hydraulic assembly and thus the cost of the hydraulic assembly are considerably lower than if the hydraulic assembly were designed for the process pressure of the dust system. The pressure intensification ratio (primary pressure/secondary pressure) is thus generally approximately 2-30. As a result of the reduction of the volume flows in the primary hydraulics and the switching processes that take place there, pressure shocks can be reduced or avoided entirely. In the case of a diaphragm rupture, the hydraulic assembly remains undamaged, because dust can then ingress only into the primary hydraulics, but not into the secondary hydraulics. Different hydraulic fluids may be used for primary hydraulics and secondary hydraulics, which permits an improved adaptation to the respective process conditions. As a result of the separation into primary and secondary hydraulics, it is made possible for multiple pump heads to be operated using one hydraulic assembly, and also, in the event of failure of one or multiple pump heads, for the respective other pump heads to continue to be operated.

A further advantage of the method as a whole is that the high-pressure gas demand is yet further reduced in relation to the system described in DE102011007066A1, because firstly the dead volume that still has to be expanded after the delivering-out process can be designed to be yet smaller owing to the smaller pipeline cross sections, and secondly, during the delivering-out process, the previously supplied charging gas is jointly utilized for the pneumatic delivery.

In a further embodiment, multiple pump heads operate in a phase-offset manner with respect to one another. The delivery process is homogenized by means of this measure.

In a particular embodiment, the diaphragm is mechanically guided by means of one or more pistons or else guide rods 10, whereby undesired deformations of the diaphragm are avoided. By means of the position of the piston or of the guide rod 10 relative to the housing 9, a position measurement of the diaphragm 3 is realized.

Advantageous refinements of the invention are specified in the subclaims.

BRIEF DESCRIPTION OF THE DRAWINGS

The invention will be discussed in more detail below as an exemplary embodiment, to an extent required for understanding, on the basis of figures, in which.

In the figures, the same reference designations are used to denote identical elements.

DETAILED DESCRIPTION OF INVENTION

The dust pump according to the invention and the method implemented therewith are suitable for fine-grain bulk materials or dusts which can be loosened and fluidized by means of a feed of gas, such as for example carbon dust, and is directed in particular to the provision of a supply to pressurized carbon dust gasifiers with dry carbon dust infeed. Here, the process pressures lie in the range from 1 to 10 MPa. The method may however basically also be used for all other processes where it is sought to pump fluidizable dusts to high pressure in dry form.

Figure 1:
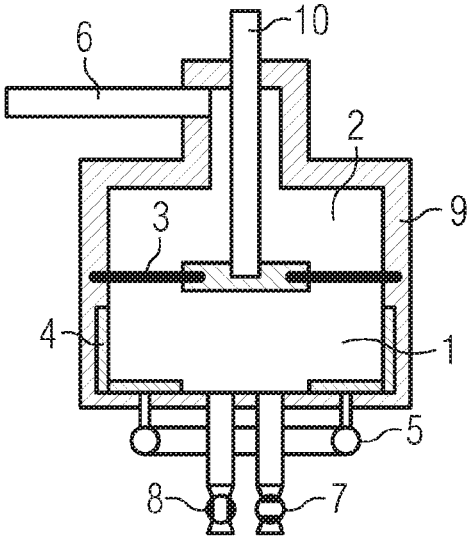
FIG. 1 shows a pump head according to the invention.
Figure 2A:
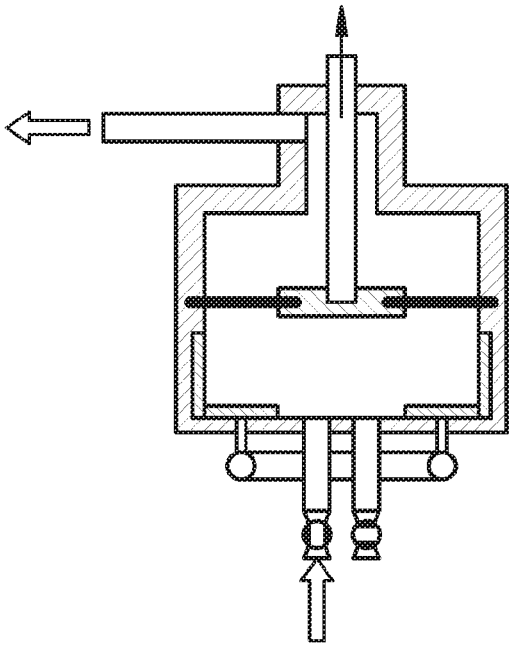
FIG. 2 shows the major process steps of the pump cycle.
Figure 2B:
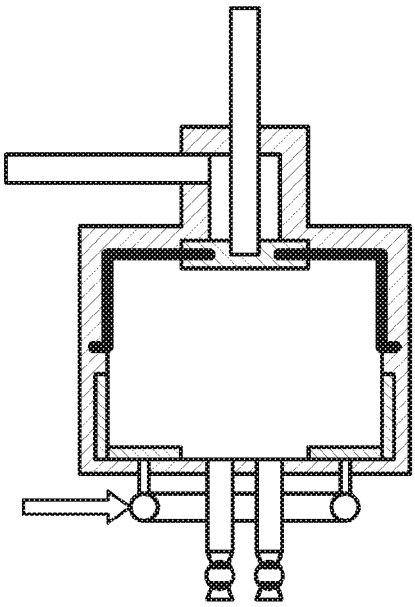
Figure 2C:
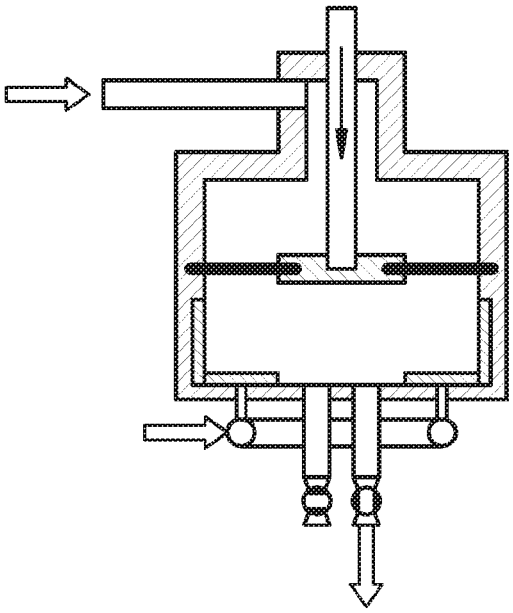
Figure 2D:
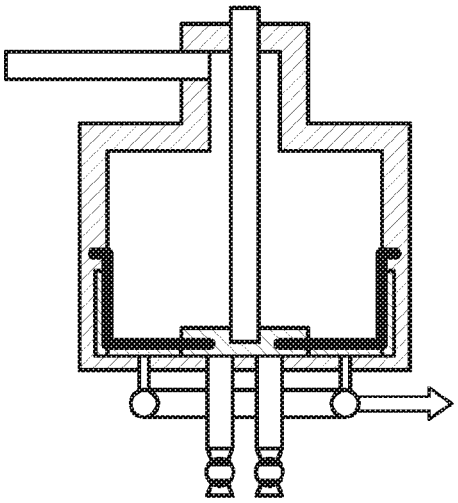

In the case of the pump head as per FIG. 1, an elastic, movable diaphragm 3 is situated in a pressure-bearing housing 9, which diaphragm separates the dust chamber 1 from the hydraulic chamber 2 in a hermetically sealed fashion. The diaphragm is guided centrally by means of a guide rod 10 and is moved downward and upward by means of a feed or withdrawal, respectively, of hydraulic fluid via the connection line 6. Dust is drawn into the dust chamber via the inlet valve 8 and is delivered out of the dust chamber via the outlet valve 7. For the purposes of loosening, charging and discharging, gas is fed or discharged, respectively, via the connection lines 5 and the gas-permeable loosening surfaces 4.

FIG. 2 illustrates the pump cycle on the basis of four sequence steps A) to D).

In step A), liquid is withdrawn from the hydraulic chamber, whereby the diaphragm is pulled upward and negative pressure is generated in the dust chamber. In this way, dust is drawn out of the hopper 11. It is assumed that the dust is situated in the hopper in a fluidized state by means of a feed of gas. During the pneumatic delivery into the dust chamber 1 by deflection of the diaphragm 3, a negative pressure is generated in the dust chamber 1, whereby the delivery is assisted.

When the diaphragm has reached the upper end position, then in step B), by closure of the inlet fitting 8 and by means of a feed of gas via the gas ports 5, the dust chamber is charged to the pressure defined by the pressure of the consumer 20 plus the pneumatic delivery pressure loss between pump head 14 and consumer (approximately 0.1 to 1 MPa).

In step C), for the delivering-out process, the outlet fitting 7 is opened, and the dust is, with a feed of gas, delivered out via the gas ports 5. At the same time, the volume of the dust chamber is reduced by means of the diaphragm 3 as a result of a feed of hydraulic liquid via the hydraulic port 6 into the hydraulic chamber.

In step D), the structurally inevitable residual volume of the dust chamber is expanded, and the pump cycle begins again from the start with step A).

During the induction of the bulk material, the pressure in the dust chamber 1 lies approximately 0.01 to 0.08 MPa below the pressure in the hopper 11 (delivery pressure differential). In a particular embodiment of the invention, the negative pressure in the dust chamber 1 is generated by virtue of negative pressure being applied via the gas port 5. Here, during the pneumatic delivery of dust into the dust chamber, the delivery pressure differential is generated by means of the evacuation of the dust chamber by means of a vacuum pump. The negative pressure applied via the gas port (5) is equal in magnitude to the delivery pressure differential, or is equal in value to the delivery pressure differential.

Figure 3:
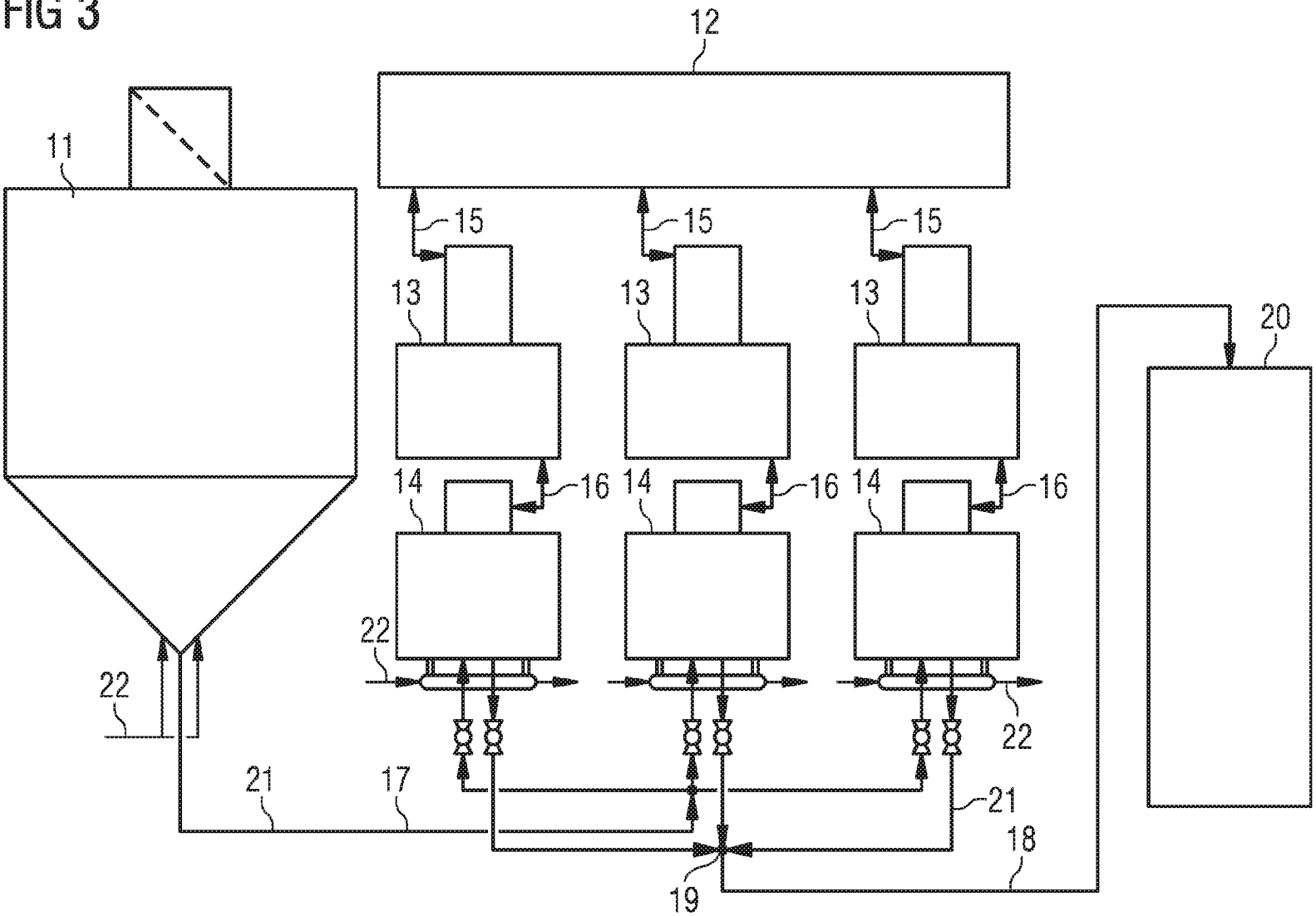
FIG. 3 shows the incorporation of multiple pump heads into a dust pump system.

Since an individual pump head 14 operates on a batch-by-batch basis (discontinuously), multiple pump heads are interconnected, as illustrated in FIG. 3, to form a dust pump system, wherein a continuous dust delivery flow can be achieved. At least 2 pump heads are arranged for this purpose. Depending on the required throughput and availability requirements, any desired number of pump heads may be interconnected. If a multiplicity of n pump heads are arranged, these may be operated so as to be phase-offset with respect to one another by $2\pi/n$ of the pump cycle. Aside from the advantage of the continuous delivery of dust, it is possible here for the hydraulic assembly to be dimensioned to be smaller for a given throughput than would be the case with discontinuous operation. In the case of this embodiment, the effects on the pressure regime of the consumer 20 are also reduced.

An entrained-flow gasifier is supplied with 100 t/h of carbon dust at 5 MPa gasification pressure. The pressure loss between dust pump and gasifier is 1 MPa, whereby the delivery pressure is 6 MPa. The dust pump system is equipped with n=10 pump heads. One pump head thus delivers 10 t/h. The cycle time of a pump head amounts to 20 seconds, whereby a required volume of the dust chamber is determined as 0.15 $m^3$, and the intake volume flow is determined as 270 $m^3$/h. The hydraulic assembly operates with an operating pressure of 30 MPa and with a volume flow of 54 $m^3$/h. Since further gas is fed during the charging and delivering-out process, the pressure delivery volume flow corresponds to 300 $m^3$/h. The result is a high-pressure gas requirement of approximately 16,000 $Nm^3$/h. This corresponds to an electric drive power of the gas compressor of approximately 2.36 MW. For a conventional lock system, approximately 2.3 times these values, specifically 36,800 $Nm^3$/h and 5.43 MW of compressor power, would be necessary. With an efficiency of the hydraulic assembly of 80%, the electrical power consumption of the dust pump is determined as 0.5 MW. In this example, with the dust pump process proposed here, 2.57 MW of electrical energy, or 20,800 $Nm^3$/h of high-pressure delivery gas, is saved in relation to a conventional lock system.

In a particular refinement of the invention, the fittings, specifically the outlet valve 7 and the inlet valve 8, are provided in a wear-resistant design.

In a particular refinement of the invention, the charging or discharging of the dust chamber 1 with gas takes place via a large-area, gas-permeable loosening surface 4 which is impermeable to the bulk material in dust form.

In a particular refinement of the invention, a large-area, gas-permeable loosening surface 4 is integrated on the base of the dust chamber 1, through which loosening surface the inlets and outlets of the dust to be delivered pass.

In a particular refinement of the invention, the loosening surface is selected to be as large as possible in relation to the inner surface of the dust chamber (at least 30% of the inner surface of the dust chamber), whereby lower gas speeds in the bulk material are realized, and a compression of the bulk material is avoided.

In a particular refinement of the invention, during the delivering-out of the bulk material, the pressure in the dust chamber lies approximately 0.1 to 1 MPa above the pressure of the receiving vessel or else dosing vessel 20.

In a particular refinement of the invention, the hydraulic system is divided into primary hydraulics and secondary hydraulics, wherein the primary hydraulics are connected to the diaphragm 3 and the secondary hydraulics are driven by means of a pressure intensifier. The pressure intensification ratio (primary pressure/secondary pressure) may be approximately 2 to 30. The primary and secondary hydraulics may be operated with different hydraulic fluids. The pressure intensifier may be designed as a pressure intensifier piston. The pressure intensifier may be designed to be resettable by means of a resetting spring, wherein the resetting spring may be designed as a mechanical spring or as a pneumatic gas pressure spring.

In a particular refinement of the invention, at least two pump heads are combined to form a system, the pressure delivery lines 18 of which are merged 19, which permits an uninterrupted delivery of bulk material.

In a particular refinement of the invention, a suction delivery line 17 proceeds from the hopper 11, which suction delivery line branches to multiple pump heads.

The present invention has been discussed in detail on the basis of specific exemplary embodiments for illustrative purposes. Here, elements of the individual exemplary embodiments may also be combined with one another. The invention is therefore not intended to be restricted to individual exemplary embodiments, but is only intended to be limited by the appended claims.

LIST OF REFERENCE DESIGNATIONS

1 Dust chamber
2 Hydraulic chamber
3 Diaphragm
4 Gas-permeable loosening surface, dust-impermeable filter
5 Gas port
6 Hydraulic port
7 Outlet valve
8 Inlet valve
9 Pressure-bearing housing
10 Diaphragm guide rod
11 Hopper
12 Hydraulic assembly
13 Pressure intensifier
14 Pump head
15 Primary hydraulics
16 Secondary hydraulics
17 Pneumatic suction line
18 Pneumatic pressure line
19 Merging point
20 Consumer, receiver (e.g. entrained-flow gasifier, carbon dust burner)
21 Bulk material
22 Gas

The invention claimed is:

1. A diaphragm pump for the pneumatic high-pressure delivery of 1 to 10 MPa fluidized dusts, comprising:
- a pressure-tight housing,
- wherein the volume in the housing is divided by a levelly arranged diaphragm into a lower dust chamber and an upper hydraulic chamber,
- wherein the lower dust chamber has, from below, an entrance for the dust which can be shut off by means of an inlet fitting,
- wherein the lower dust chamber has, from below, an exit for the dust which can be shut off by means of an outlet fitting,
- wherein at the base of the lower dust chamber, there is arranged gas-permeable loosening surfaces which are connected to a gas port,
- wherein the hydraulic chamber is connected to a hydraulic port for the supply and discharge of hydraulic fluid,
- wherein the entrance for the dust and the exit for the dust are arranged parallel to each other at the base of the lower chamber, and
- wherein the diaphragm pump is configured to operate so that a hub of the diaphragm comes into contact with the housing and covers the entrance for the dust and the exit for the dust while fitting between the loosening surfaces.

2. The diaphragm pump as claimed in claim 1, wherein the diaphragm is guided centrally by means of a guide rod.

3. The diaphragm pump as claimed in claim 1, wherein the hydraulic port is connected via a pressure intensifier to a hydraulic assembly.

4. The diaphragm pump as claimed in claim 3, wherein the pressure intensifier is designed as a pressure intensifier piston.

5. The diaphragm pump as claimed in claim 1, wherein the diaphragm pump is arranged at the same height as a hopper.

6. The diaphragm pump as claimed in claim 1, wherein the diaphragm pump is provided in a manifold arrangement.

7. The diaphragm pump as claimed in claim 1, wherein the entrance for the dust and the exit for the dust pass through the loosening surfaces.

8. A method for the pneumatic high-pressure delivery of fluidized dusts by means of the diaphragm pump as claimed in claim 1, in a dust delivery device, wherein the dust delivery device has a hopper comprising an outlet, the hopper contains fluidized dust in bulk material form, the outlet of the hopper is connected via a pneumatic suction line to the inlet fitting of the diaphragm pump, the method comprising:

hydraulically deflecting the diaphragm upward, so that a negative pressure is generated in the lower dust chamber and fluidized dust is drawn into the lower dust chamber via the opened inlet fitting, closing the inlet fitting, charging the lower dust chamber to the required high pressure with gas via the gas port, opening the outlet fitting, delivering the dust out of the lower dust chamber by means of a feed of gas via the gas port, while at the same time the volume of the lower dust chamber is reduced by hydraulic deflection of the diaphragm downward.

9. The method as claimed in claim 8, wherein the lower dust chamber is relieved of pressure.

10. The method as claimed in claim 8, wherein the dust delivery device comprises at least one additional diaphragm pump having the same structure as the diaphragm pump; and wherein the pump cycles of the diaphragm pumps take place in a phase-offset manner with respect to one another.

11. The method as claimed in claim 8, wherein the negative pressure in the lower dust chamber is generated by virtue of negative pressure being applied via the gas port.

12. The method as claimed in claim 11, wherein a negative pressure equal in magnitude to a delivery pressure differential is applied via the gas port.

13. The method as claimed in claim 8, wherein the hopper is at atmospheric pressure.

* * * * *